US006253930B1

(12) United States Patent
Freidus et al.

(10) Patent No.: US 6,253,930 B1
(45) Date of Patent: Jul. 3, 2001

(54) DISPENSING CARTON ASSEMBLY

(75) Inventors: Scott D. Freidus, Alexandria, KY (US); James M. Ciesick, Cincinnati, OH (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 08/907,846

(22) Filed: Aug. 8, 1997

(51) Int. Cl.[7] ..... A47F 1/04; B65D 5/72; B65D 1/22

(52) U.S. Cl. ..... 211/59.2; 211/59.2; 211/74; 211/85.18; 312/45; 312/72; 312/71; 221/309; 221/312 R; 221/312 C; 229/122.1; 229/122.2; 229/122

(58) Field of Search ..... 211/59.2, 85.18, 211/74, 85, 85.17, 72, 59.3; 206/555; 248/174; 229/122.1, 122.2, 122; 221/309, 312 R, 312 C

(56) References Cited

U.S. PATENT DOCUMENTS

| | | | | |
|---|---|---|---|---|
| 1,341,893 | * | 6/1920 | Fitz Gerald | 312/45 X |
| 2,299,027 | * | 10/1942 | Novak | 229/122.1 |
| 2,708,085 | * | 5/1955 | Bonaccorsi | 248/174 X |
| 2,795,354 | * | 6/1957 | Freundlich et al. | 221/312 R |
| 2,852,327 | * | 9/1958 | Mason | 312/45 |
| 2,901,118 | * | 8/1959 | Beesley | 211/49 |
| 2,996,344 | * | 8/1961 | Garman | 312/45 |
| 3,055,293 | * | 9/1962 | Lariccia | 101/44 |
| 3,298,763 | * | 1/1967 | Di Domenico | 312/45 |
| 3,300,115 | | 1/1967 | Schauer | 221/309 X |
| 3,332,594 | * | 7/1967 | De Capua | 221/309 X |
| 3,351,209 | * | 11/1967 | Kofoed et al. | 211/59.2 |
| 3,356,279 | | 12/1967 | Root | 229/122.1 X |
| 3,416,719 | * | 12/1968 | Pilger | 229/122.1 X |
| 3,450,308 | | 6/1969 | Schoenefeld | 221/309 X |
| 3,533,536 | * | 10/1970 | Baxendale | 211/281 |
| 3,743,137 | * | 7/1973 | Bennett | 211/289 |
| 3,894,681 | * | 7/1975 | Arneson et al. | 229/122.1 X |
| 4,214,660 | * | 7/1980 | Hunt, Jr. | 229/122 X |
| 4,283,000 | * | 8/1981 | White | 229/122.1 X |
| 4,287,992 | * | 9/1981 | Takemori | 312/45 X |
| 4,435,026 | * | 3/1984 | Johnson | 312/45 |
| 4,530,548 | | 7/1985 | Spamer et al. | 312/45 |
| 4,911,309 | * | 3/1990 | Stefan | 211/59.2 |
| 5,009,329 | * | 4/1991 | Farrentine | 312/45 X |
| 5,163,558 | * | 11/1992 | Palumbo et al. | 221/309 X |
| 5,462,198 | * | 10/1995 | Schwimmer | 211/130 |
| 5,597,114 | | 1/1997 | Kramedjian et al. | 229/122.1 |

* cited by examiner

*Primary Examiner*—Alvin Chin-Shue
*Assistant Examiner*—Khoa Tran
(74) *Attorney, Agent, or Firm*—Blank Rome Comisky & McCauley LLP

(57) ABSTRACT

A carton assembly for dispensing product members such as spools of wire and other rollable products having circular ends of the same diameter. The carton comprises a bottom, forward and rearward end walls, two side walls and a closable top. Within the carton each side wall has associated therewith one upper guide member, at least one intermediate guide member and a lower guide member. The guide members of one wall are mirror images of the corresponding guide members of the other side wall and are correspondingly positioned with respect to their respective side walls. The intermediate and lower guide members provide narrow sloping edges in parallel spaced relationship which maintain the product members in a row made up of zig-zag row segments, one above the other. The carton has a dispensing opening in its forward wall through which the forwardmost and lowermost product member can be extracted. The dispensing opening is so located in the forward wall as to provide a low retaining wall therebelow to retain each product member when it becomes the forwardmost and lowermost product member. The upper guide members have parallel spaced lower edges which help maintain the product elements in proper position, regardless of the orientation of the carton. The upper guide members of such length as to permit loading of the carton from the top.

8 Claims, 4 Drawing Sheets

DISPENSING CARTON ASSEMBLY

TECHNICAL FIELD

A carton assembly for dispensing products having circular ends of the same diameter such as spools of wire and the like, and more particularly to such a carton which has guide elements associated with the inside surfaces of its side walls, the guide elements providing parallel spaced edges which serve as rail-ike surfaces along which the product members can roll in a zig-zag fashion toward the dispensing opening of the carton.

BACKGROUND ART

The dispensing carton of the present invention can be used with any product members which have circular ends of substantially the same diameter so that they can roll on parallel spaced guide element edges serving as supporting rail-like surfaces. An excellent example of the type of product to which the present invention is directed are spools of wire such as THHN wire, speaker wire, lamp cord wire and the like.

Heretofore, products of this sort have most usually been packaged in non-dispensing cartons. When a spool of wire was removed from a supporting shelf in a retail establishment or in the storage facility of a factory, or the like, the shelf needed to be restocked.

In some instances, prior art workers have packaged reels of wire arranged in vertical rows one above the other. The package has been provided with a lower front opening through which the lowermost and front most spool could be extracted. When this was done, the next reel above would simply drop to a position accessible through the dispensing opening. This frequently resulted in spool breakage since some spools of wire weigh from about 8 to 10 pounds. If the next spool dropped upon user's hand or finger, it could cause pain or injury.

The present invention is based upon the development of a dispensing carton assembly of very simple and sturdy construction and through which the spools of wire roll in a zig-zag path through the carton to the carton dispensing opening from which the lowermost and forwardmost spool can be extracted. The zig-zag path is defined by guide members associated with the carton side walls and providing upper edges which serve as rail-like surfaces along which the spool ends can roll. The spools advance from the top of the carton along the zig-zag guide edges to the dispensing opening at the lower forward portion of the carton safely, and without free-fall. The dispensing carton significantly reduces the number of times a supporting shelf must be restocked. Since the dispensing carton rests on the shelf in an upright position, it takes up a minimum of shelf space.

DISCLOSURE OF THE INVENTION

According to the invention there is provided a carton assembly for dispensing product members such as spools of wire and other rollable products having circular ends of substantially the same diameter.

The carton comprises a bottom, forward and rearward end walls, side walls, and a closable top. Within the carton each side wall has associated therewith one upper guide member, at least one intermediate guide member, and a lower guide member. The guide members of one side wall are mirror images of the corresponding guide members of the other side wall and are correspondingly positioned with respect to their respective side walls. The guide members may be affixed directly to the carton side walls, or they may be affixed to an insert comprising a pair of side walls and a rear wall adapted to lie along the side walls and rear wall of the carton.

The intermediate and lower guide members provide narrow sloping edges in parallel spaced relationship and serve as rail-like supporting edges, maintaining the product members in a row made up of zig-zag row segments, one above the other.

The carton has a dispensing opening in its forward wall through which the forwardmost and lowermost product member can be extracted. The opening extends a short distance into each of the side walls to make product removal easier.

The dispensing opening is so located in the forward wall as to provide a low retaining wall therebelow. The retaining wall serves as a stop for each product member when it becomes the forwardmost and lowermost product member. The upper guide members have parallel spaced lower edges which help maintain the product elements in proper position, regardless of the orientation of the carton. The upper guide members are configured to permit loading of the spools into the carton from the top thereof.

DETAILED DESCRIPTION OF THE INVENTION

Figure 1:
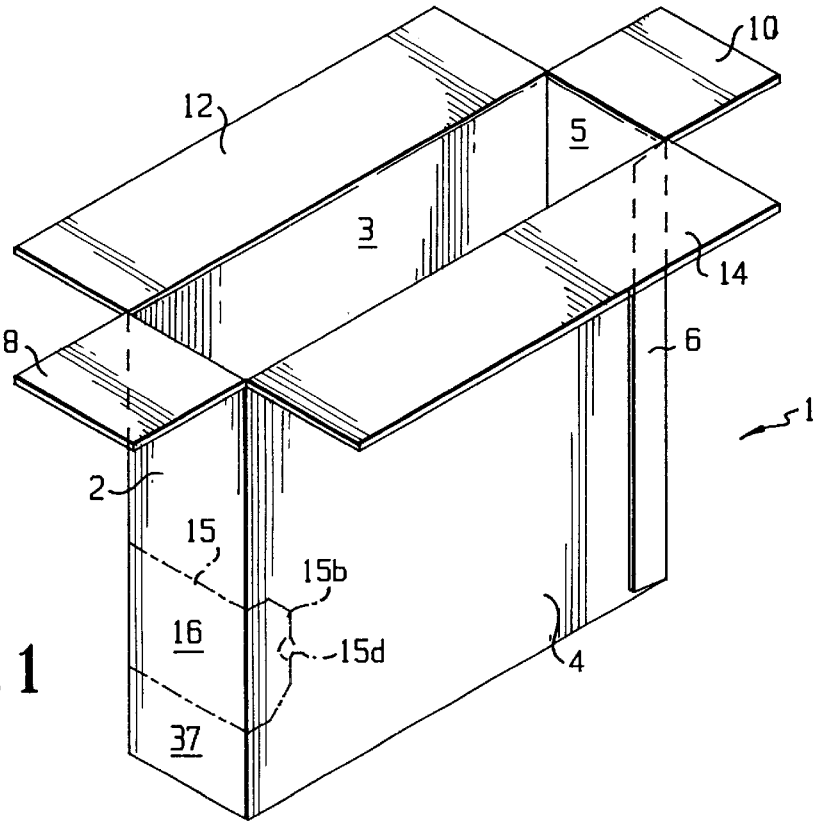
FIG. 1 is a perspective view of the carton of the present invention with its top flaps open.
Figure 2:
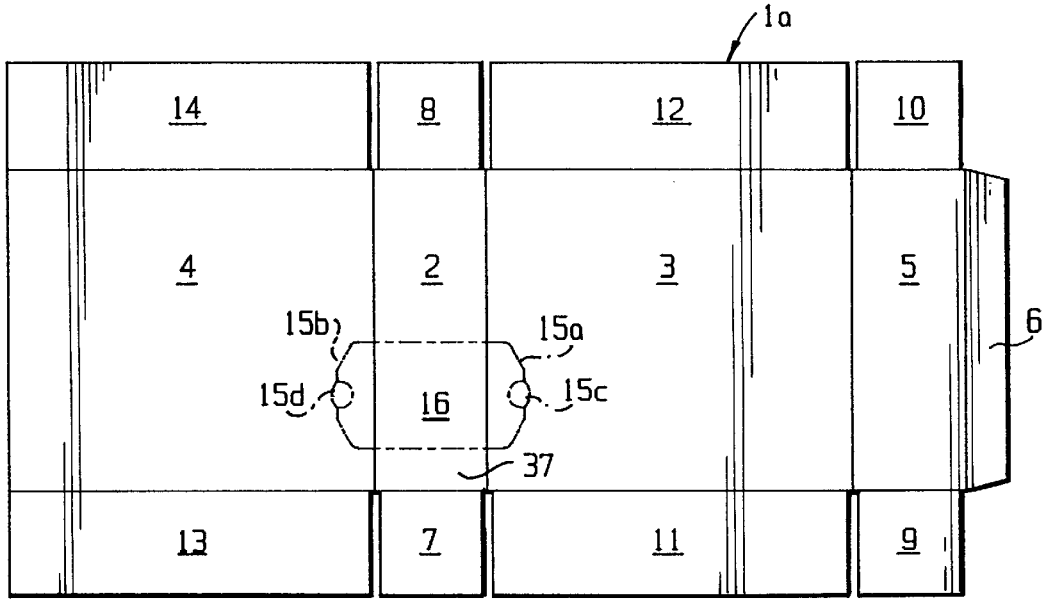
FIG. 2 is an elevational view of the blank from which the outside carton of FIG. 1 is made illustrating the inside surface of the carton blank.

Throughout the description, like parts have been given like index numerals. As indicated above, the dispensing carton assembly of the present invention is made up of two basic parts, a fully closable carton and an insert bearing guide numbers. The carton, itself, is generally indicated at 1 and is best shown in FIGS. 1 and 2. FIG. 2 illustrates the inside surface of the carton blank 1*a*. As is most clearly shown in FIG. 2, the carton blank 1*a* comprises a front wall 2, a pair of side walls 3 and 4, and a rear wall 5. The vertical edge of rear wall 5, opposite its vertical edge adjacent side wall 3, carries an assembly tab 6. As is clearly illustrated in FIG. 1, the front wall 2, side walls 3 and 4, and rear wall 5 are folded into a rectangular shape. The assembly tab 6 is glued to the outside surface of side wall 4 at the free end thereof, to maintain the side and end walls in the rectangular configuration shown.

Front wall 2 carries a bottom closure flap 7 and a top closure flap 8. Similarly, the rear wall 5 carries a bottom closure flap 9 and a top closure flap 10. Side wall 3 carries a bottom closure flap 11 and a top closure flap 12, while side wall 4 carries a bottom closure flap 13 and a top closure flap 14.

Figure 6:
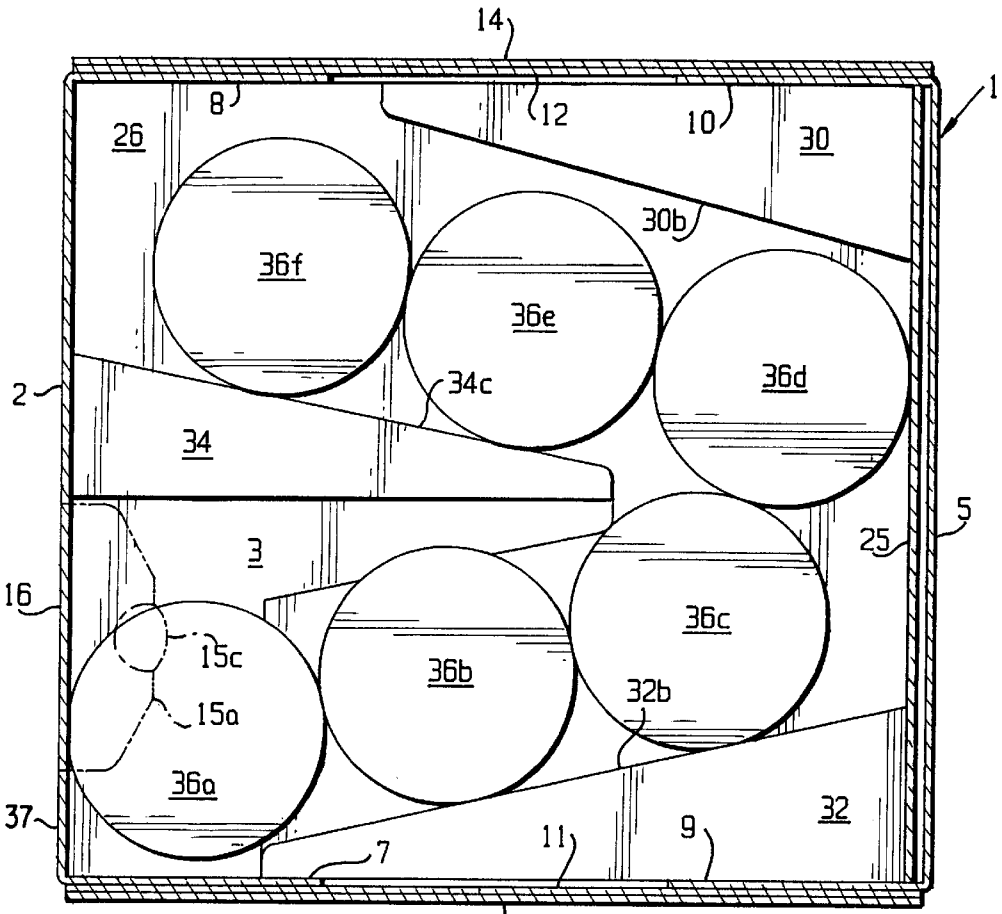
FIG. 6 is a cross-sectional view of the carton assembly, taken along section line 6—6 of FIG. 5.
Figure 5:
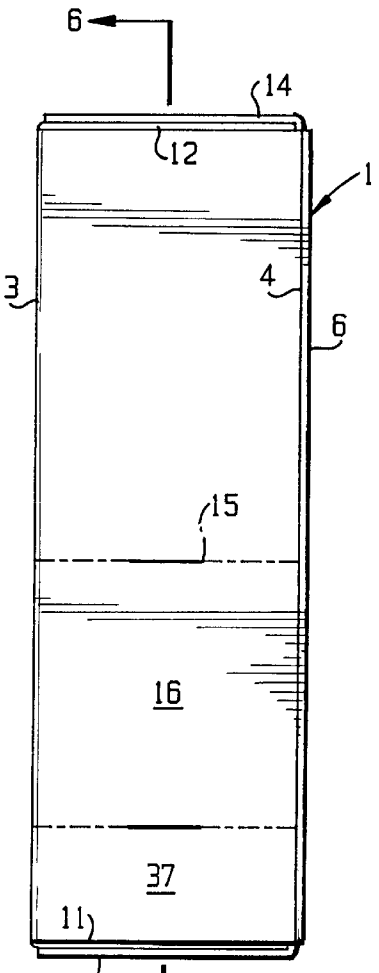
FIG. 5 is a front end elevational view of the carton assembly of the present invention.

FIGS. 1, 5 and 6 illustrate the bottom closure flaps in closed condition. To achieve this, end flaps 7 and 8 are first folded inwardly, followed by flap 13 and then flap 11. The top flaps 8, 10, 12 and 14 are shown open in FIG. 1 and closed in FIGS. 5 and 6. When the top flaps are closed, end flaps 8 and 10 are first folded inwardly, followed by flap 12 and then flap 13.

The carton 1 is completed by providing a tear-out dispensing opening which is initially closed for shipping and storage. The opening is indicated at 15 in FIGS. 1, 2 and 5 with portions 15*a* and 15*b* which extend into side walls 3 and 4, respectively. In FIGS. 1, 2 and 5 the opening 15 and its extensions 15*a* and 15*b*are illustrated in broken lines since opening 15 initially defined by a continuous line of perforations in front wall 2 and side walls 3 and 4. At the outermost parts of the extensions 15*a* and 15*b* there are perforated portions 15*c* and 15*d* which may be punched inwardly to provide finger holes. In this manner, the tear-out part 16 of the carton may be manually engaged and removed to form dispensing opening 15. It will be noted that the dispensing opening 15 is spaced upwardly from the bottom edge of front panel 2 to form an abutment wall, as will be apparent hereinafter. The opening extensions 15*a* and 15*b* enable the forwardmost and bottom most spool of wire to be manually lifted through the dispensing opening 15.

Figure 7:
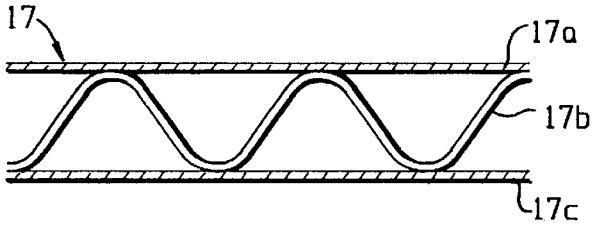
FIG. 7 is a fragmentary cross-sectional view of a single ply corrugated board from which some portions of the carton assembly are made.

It will be understood that the carton 1 can be made of any appropriate material. Excellent results have been achieved using a single ply corrugated cardboard of the type shown at 17 in FIG. 7, comprising an outer sheet 17*a*, a corrugated sheet 17*b*, and an inner sheet 7*c*.

Figure 3:
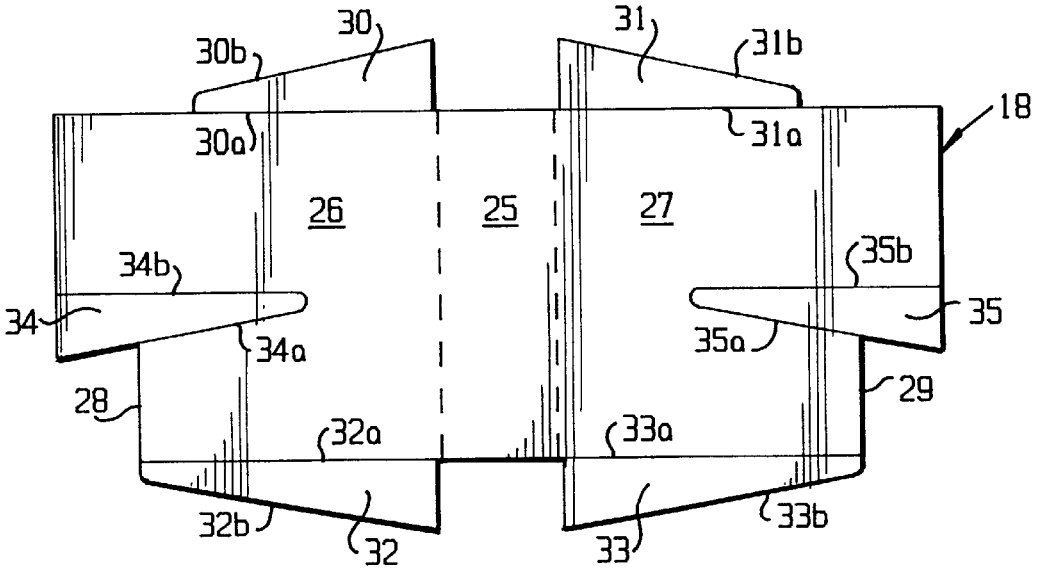
FIG. 3 is an elevational view of the blank from which the insert of the present invention is made, illustrating the inside surface of the insert blank.
Figure 8:
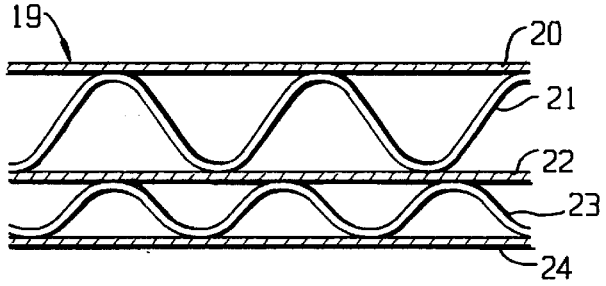
FIG. 8 is a fragmentary cross-sectional view of a double ply corrugated board from which some parts of the carton assembly of the present invention are made.

Reference is now made to FIG. 3 which is an elevational view showing the inside surface of the blank or insert generally indicated at 18. The insert 18 may be made of any appropriate material. Excellent results have been achieved using a two-ply corrugated board such as is shown in FIG. 8 at 19. The two-ply corrugated board 19 comprises an outer sheet 20, a first corrugated sheet 21, an intermediate sheet 22, a second corrugated sheet 23, and an inner sheet 24. In FIG. 3, the inside surface of insert 18 is shown. The insert 18 comprises a rear wall 25 flanked by side walls 26 and 27. Rear wall 25 is sized to abut the inside surface of rear wall 5 of the carton 1. Side walls 26 and 27 are sized to fit against and abut carton side walls 3 and 4, respectively. It will be noted that side walls 26 and 27 have their lower forward corners notched as at 28 and 29 so that the insert does not interfere with the dispensing opening extensions 15*a* and 15*b*.

The upper edges of side walls 26 and 27 are provided with upper guide elements 30 and 31, which constitute an integral, one-piece part of blank 18. It will be noted that the upper guide elements 30 and 31 do not extend all the way to the forward edges of side walls 26 and 27, as will be explained hereinafter.

Side walls 26 and 27 also have, along their bottom edges, bottom guide elements 32 and 33, respectively which extend from points just inside the rear edges of side walls 26 and 27 to the notches 28 and 29, respectively.

Finally, the side walls 26 and 27 of insert 18 have triangular intermediate guide elements 34 and 35, respectively. The rail elements 34 and 35 constitute an integral, one-piece part of blank 18.

Along the line of juncture 30*a* between guide element 30 and insert side wall 26 and along the line of juncture 31*a* between guide element 31 and insert side wall 27 the blank 18 is cut from the outside surface through the outside sheet 20, corrugated sheet 21, intermediate sheet 22 and corrugated sheet 23, but not through inside sheet 24 (see FIG. 8). The same is true of the lines of juncture 32*a* and 33*a*between the guide elements 32 and 33 and the side walls 26 and 27, respectively. As a result of this, glue may be applied to the inner surface of guide elements 30, 31, 32 and 33. The guide elements 30 and 31 may be folded downwardly (as shown in FIG. 3) to the positions shown in FIG. 4. Similarly, the guide elements 32 and 33 may be folded upwardly to the positions shown in FIG. 4. In each instance, the inner ply 24 (see FIG. 8) is folded and glued to itself.

With respect to guide element 34 of side wall 26, the side wall is cut all the way through along line 34*a*. Along line 34*b*, side wall 26 is cut through outer sheet 20, corrugated sheet 21, intermediate sheet 22 and corrugated sheet 23, but not through inner sheet 24. The same is true with respect to guide element 35 of side wall 27. The side wall is cut through along line 35*a*, and is cut along 35*b* with the exception of inner sheet 24. Glue is applied to the inside surfaces of guide elements 34 and 35 and they are bent upwardly, as viewed in FIG. 3, to the positions shown in FIG. 4.

It will be understood that with respect to each of the upper guide elements 30 and 31, lower guide elements 32 and 33, and intermediate guide elements 34 and 35 the inner sheet 24 of the blank serves as a hinge during the guide element folding process and thereby properly locates each of the guide elements on the inside surface of insert 18. It would be within the scope of the invention to make the upper and lower guide elements 30–33, or all of the guide elements 30–35, as separate pieces to be adhered to the inside surface of insert 18.

Figure 4:
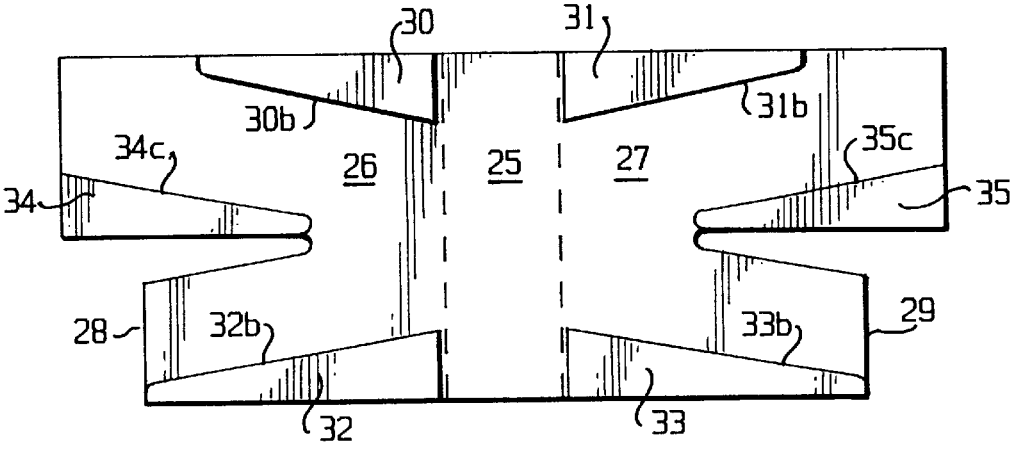
FIG. 4 is an elevational view of the insert of FIG. 3 with the rail elements folded and glued in position.

Reference is now made to FIG. 6, which is a cross-sectional view of the carton 1 and insert 18, taken along section line 6—6 of FIG. 5. The completed insert 18, as shown in FIG. 4, is bent along the lines of junction between its rear wall 25 and its side walls 26 and 27. Thereafter, the insert is lowered into the carton 1 with the exterior side of the insert rear wall 25 abutting the inside surface of the carton rear wall 5 and the exterior surfaces of insert side walls 26 and 27 abutting the inside surfaces of carton side walls 3 and 4, respectively. As is apparent from FIG. 6, in the particular embodiment illustrated, the carton 1 holds 6 spools 36*a*–36*f*. The uppermost guide element 30 (and the corresponding uppermost guide element 31, not shown in FIG. 6) have edges 30*b* and 31*b* (see FIG. 4) which serve primarily to maintain the upper row of spools 36*d*–36*f* in proper position when carton 1 is supported on any one of its exterior surfaces other than its bottom. The intermediate guide element 34 and the bottom guide element 32 and their counterparts 35 and 33 on insert side 27 (not shown) serve the same purpose as guide elements 30 and 31 when the carton is in any position other than its upright position as shown in FIG. 6. When in its upright position, the intermediate guide elements 34 and 35 and the bottom guide elements 32 and 33 provide upper, rail-like edges 34*c*, 35*c*, 32*b* and 33*b* (see also FIG. 4) which support the spools and along which they may roll during a dispensing operation. Guide elements 34, 35, 32 and 33 arrange spools 36*a*–36*f* in a "zig-zag" path of travel, as is apparent from FIG. 6.

The carton 1 of the present invention and its insert 18 having been described in detail, its mode of operation may now be set forth. The carton 1 is erected as shown in FIG. 1, with its top flaps 8, 10, 12 and 14 in open position. The insert 18, having been bent along the junctures of its rear wall 25 and side walls 26 and 27 is inserted in the open top of carton 1.

It will be noted that the free vertical edge of side wall 3 extends all the way to the inside surface of the carton front wall 2. The same is true of side wall 27. The upper guide element 30, on the other hand, does not extend all the way to the front wall 2 of the carton, but is spaced therefrom by a distance slightly greater than the diameter of each spool 36*a*–36*f*. The same is true of guide element 31 (see FIG. 4). As a result of this, the carton can be filled with spools by introducing the spools through the carton top adjacent the carton front wall 2. It will also be apparent from FIG. 6 that the notch 28 in the lower left hand comer of insert wall 26 assures that the insert will not interfere with the extended portion 15*b* of dispensing opening 15. It will be understood that the notch 29 of insert 18, formed in the lower right corner of wall 27 (as viewed in FIG. 4) will accomplish the same purpose with respect to the dispensing opening extended portion 15*a*.

As is most clearly shown in FIG. 5, the opening 15 is of such a height that any one of spools 36*a*–36*f* can readily be extracted therefrom. It will further be noted in FIG. 5 that the opening 15 is spaced upwardly from the bottom of carton 1 thereby providing a retaining wall indicated at 37. The purpose of retaining wall 37 is to maintain the forwardmost spool of the carton within the carton until manually extracted therefrom.

It will be understood that the rail-ike upper edges 34*c* and 35*c* of the intermediate guide elements 34 and 35 and the upper rail-like edges 32*b* and 33*b* of the lower guide elements 32 and 33 are of sufficient width to support the circular ends of the spools 36*a*–36*f*, the guide elements being made of double ply board. The zig-zag path of travel of the rolls 36*a*–36*f*, induced by the intermediate guide elements 34 and 35 and the lower guide elements 32 and 33 assure that the spools will not drop, minimizing the possibility of spool breakage or injury.

Figure 9:
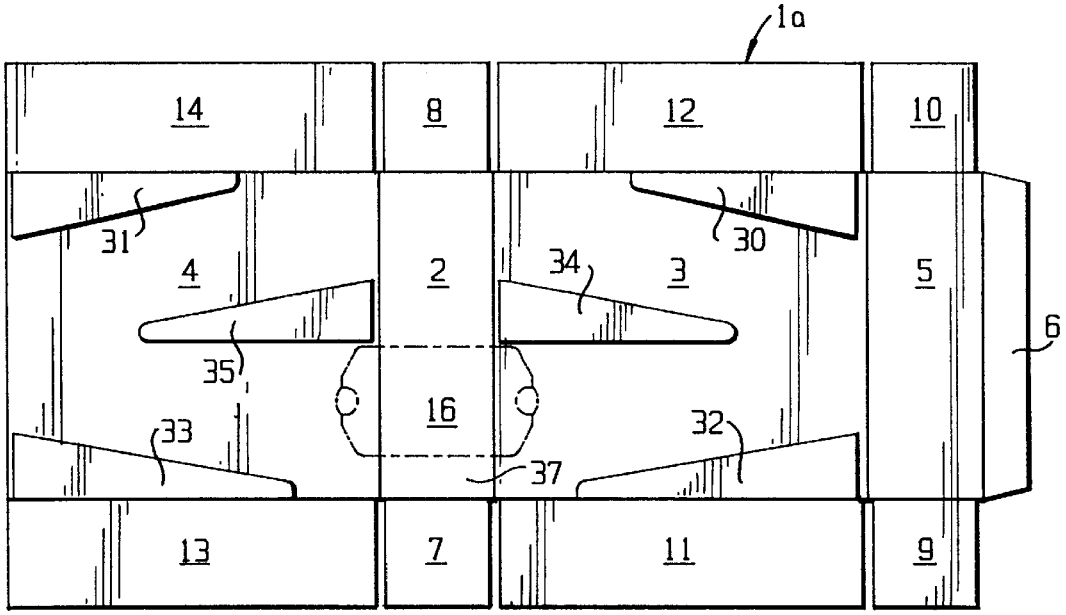
FIG. 9 is an elevational view of the blank of FIG. 2 with the guide elements affixed directly thereto.

As indicated above, the carton of the present invention may be used to dispense any product elements having circular ends of the same diameter. Depending upon the weight of the individual product elements, it would be within the scope of the invention to apply to guide elements 30, 31, 34, 35, 32 and 33 directly to the inside surface of the carton blank, as shown in FIG. 9. In FIG. 9, the carton blank 1*a* of FIG. 2 is shown. The carton blank 38*a* is provided with the upper guide elements 30 and 31, lower guide elements 32 and 33 and intermediate guide elements 34 and 35 of FIG. 4. All of the guide elements 30–35 are adhered directly to the carton blank 1*a*, rather than to an insert. It will be understood that the carton blank 1*a* may be made of single or multiple ply board. The same is true of the guide elements 39–44. It would also be well within the skill of the worker in the art to size the carton assembly to fit the product to be housed therein. In the embodiment illustrated in the Figures, the product elements are arranged in two sloping rows which move in opposite directions. It will be understood that the carton could be provided with any number of oppositely sloping rows, located one above the other.

Modifications may be made in the invention without departing from the spirit of it.

What is claimed:

1. A dispensing carton assembly for dispensing rollable product members having coaxial circular ends of the same diameter, the carton assembly comprising:

a container fabricated from a first corrugated board material with a first thickness and having a bottom, forward and rearward end walls, two side walls and a closable top; and a guide structure fabricated from a second corrugated board material with a second thickness, the guide structure including an upper guide element, at least one intermediate guide element, and a lower guide element disposed in at least close proximity with an inside surface of each side wall, said guide elements extending from the sidewalls forming edges having a width equal to the second thickness to define spaced apart ramp surfaces to support opposite end portions of the rollable product members such that the rollable product members are supported only at their edges, and being disposed in at least close proximity with one wall being mirror images of the corresponding guide elements disposed in at least close proximity with the other side wall and being correspondingly positioned with respect to their respective side walls, said intermediate and said lower guide elements providing pairs of narrow sloping edges in parallel spaced relationship, said pairs of parallel spaced edges maintaining the product members in a row comprising zig-zag row segments one above the other, said container having a dispensing opening in said forward wall sized to enable the forwardmost and lowermost of the product members to be extracted from said dispensing carton assembly, a low retaining wall comprising a part of said forward wall below said dispensing opening, said retaining wall being sized to retain each product member when it becomes the forwardmost and lowermost product member, said upper guide elements having parallel spaced lower edges positioned in parallel with the narrow sloping edges of the at least one intermediate guide element to maintain the product members in proper position, regardless of the orientation of the dispensing carton assembly, said upper guide elements being of such length as to permit loading of the dispensing carton assembly from the top.

2. The dispensing carton assembly claimed in claim 1 wherein said dispensing opening is defined by a line of perforations surrounding a portion of said forward wall, which portion, when removed, creates said dispensing opening.

3. The dispensing carton assembly claimed in claim 2 wherein said line of perforations extends partway into said container side walls, said dispensing opening having extended portions in said side walls when said container portion surrounded by said line of perforations is removed.

4. The dispensing carton assembly claimed in claim 1 wherein each of said upper guide elements extends partway across the upper edge of its respective side wall, defining an area through which product members can be loaded into said dispensing carton assembly.

5. The dispensing carton assembly claimed in claim 1 wherein the inside surface of each carton side wall has one intermediate guide element associated therewith.

6. The dispensing carton assembly claimed in claim 1 said upper guide element, said at least one intermediate guide element and said lower guide element of each side wall are affixed directly to their respective side wall.

7. A dispensing carton assembly for dispensing rollable product members having coaxial circular ends of the same diameter, the carton assembly comprising:

a container fabricated from a first corrugated board material with a first thickness and including a bottom wall, a forward wall, a rear wall and a pair of side walls spaced apart from one another and connected to and extending between the forward and rear walls to define a generally rectangular space therein, the container having a dispensing opening formed above the bottom wall and into a lower portion of the forward wall and the pair of side walls; and a guide structure fabricated from a second corrugated board material with a second thickness, the guide structure disposed within the rectangular space and including a pair of upper guide elements, a pair of lower guide elements and at least a pair of intermediate guide elements disposed between the pair of upper guide elements and the pair of lower guide elements, the guide elements extending from the sidewalls to form edges to define spaced apart ramp surfaces to support opposite end portions of the rollable product such that the rollable product members are supported only at their edges respective ones of each pair of guide elements forming respective edges having a width equal to the second thickness and being spaced apart from one another in a mirrored image relationship and extending between the forward and rear walls such that respective upper edges of the at least pair of the intermediate guide elements and the pair of lower guide elements form sloping edges to define a zig-zag path on which the product members roll and respective lower edges of the pair of the upper guide elements form edges that extend parallel to and spaced apart from the sloping edges of the intermediate guide elements at a distance sufficient to permit the product members to roll therebetween.

8. A carton assembly as recited in claim 7, wherein each one of the pair of upper guide elements extends between the forward and rear walls to terminate at an end, respective ends of the upper guide elements and an upper portion of one of the forward wall and the rear wall define a loading opening sized and adapted to receive the product members in order to load the product members in the container.

* * * * *